United States Patent [19]

Eke

[11] Patent Number: 4,691,088

[45] Date of Patent: Sep. 1, 1987

[54] MICROWAVE OVEN WITH POWER TRANSFER AUTOMATICALLY RESPONSIVE TO DIELECTRIC LOAD OF FOOD

[75] Inventor: Kenneth I. Eke, South Croydon, England

[73] Assignee: Microwave Ovens Limited, Surrey, England

[21] Appl. No.: 910,328

[22] Filed: Sep. 22, 1986

Related U.S. Application Data

[63] Continuation of Ser. No. 765,211, Aug. 13, 1985, abandoned.

[30] Foreign Application Priority Data

| | | | |
|---|---|---|---|
| Aug. 14, 1984 | [GB] | United Kingdom | 8420608 |
| Jan. 3, 1985 | [GB] | United Kingdom | 8500095 |
| Feb. 23, 1985 | [GB] | United Kingdom | 8504724 |
| May 29, 1985 | [GB] | United Kingdom | 8513536 |

[51] Int. Cl.[4] ..... H05B 6/74

[52] U.S. Cl. ..... 219/10.55 F; 219/10.55 E; 99/DIG. 14

[58] Field of Search ..... 219/10.55 F, 10.55 E, 219/10.55 B, 10.55 R, 400; 126/21 A, 21 R; 99/DIG. 14, 451

[56] References Cited

U.S. PATENT DOCUMENTS

| | | | |
|---|---|---|---|
| 2,898,437 | 8/1959 | McFarland | 219/400 X |
| 3,422,240 | 1/1969 | Parker | 219/10.55 F |
| 3,742,177 | 6/1973 | Wikstrom et al. | 219/10.55 F |
| 4,019,009 | 4/1977 | Kusunoki et al. | 219/10.55 F |
| 4,283,614 | 8/1981 | Tanaka et al. | 219/10.55 R |
| 4,337,384 | 6/1982 | Tanaka et al. | 219/10.55 R |
| 4,453,064 | 6/1984 | Toyoda et al. | 219/10.55 F |
| 4,481,396 | 11/1984 | Matsubayashi et al. | 219/10.55 B |
| 4,508,947 | 4/1985 | Eke | 219/10.55 R |

*Primary Examiner*—Philip H. Leung
*Attorney, Agent, or Firm*—Penrose Lucas Albright Pravel, Gambrell, Hewitt & Kimball

[57] ABSTRACT

A microwave oven has a magnetron which launches microwave power into a cavity of the oven through an aperture in the base of the cavity. A metal tray, which may be a shelf or a rotatable turntable is supported above the aperture in a predetermined disposition so that the oven when devoid of food presents a poor power match with the magnetron in terms of effectiveness of power transfer from the magnetron into the oven cavity. As a result, the dielectric load of food items placed in the oven determines the power coupled to the loaded oven from the magnetron and the power transfer automatically increases in proportion to the dielectric food load in the oven. A forced hot air system blows hot air through the cavity, so that food items on the tray are cooked by the simultaneous application of microwave power and the hot air.

12 Claims, 12 Drawing Figures

MICROWAVE OVEN WITH POWER TRANSFER AUTOMATICALLY RESPONSIVE TO DIELECTRIC LOAD OF FOOD

This is a continuation application of Ser. No. 06/765,211 filed 08/13/85, now abandoned.

FIELD OF THE INVENTION

This invention relates to a microwave oven with means for launching microwave power into a cavity of the oven from a launch area in the base of the cavity.

In a microwave oven microwave power is transferred from a magnetron to the oven cavity in dependence upon the effectiveness of the coupling between the load of the oven cavity and the magnetron. Hitherto, microwave ovens have been designed to achieve optimum coupling for a wide range of loads corresponding to differing sizes and densities of food items placed in the cavity. This optimization of coupling means that for a given input power to the magnetron the power into the cavity is optimized over the range of loads placed in the oven cavity. The invention adopts an entirely different approach by aiming to provide a microwave oven having a cavity which, when devoid of food, is a poor power match with the magnetron, with the result that the amount of power transferred from the magnetron to the food item being cooked is dependent almost entirely on the load of the food item.

SUMMARY OF THE INVENTION

According to the invention a microwave oven has a magnetron for producing microwave power to a cavity of the oven, means for launching the microwave power into the cavity from a launch area in the base of the cavity, and a metal tray supported in the cavity above the launch area with the peripheral edge of the tray spaced from the cavity walls so that the oven when devoid of food provides an inefficient power match with the magnetron, whereby the dielectric load of food items placed in the oven determines the power coupled to the loaded oven from the magnetron. Accordingly, in the invented microwave oven the amount of microwave power coupled into the loaded oven is substantially proportional to the dielectric load. The result of this is that the microwave oven need not have selectable microwave power settings which the user must first preset, because the load of the food item itself determines the amount of power delivered by the magnetron to the loaded cavity.

In one embodiment, the tray is stove enamelled and of rectangular or square shape. The tray may be supported in the oven by a wire rack or shelf which rests on shelf supports provided on the oven walls and which wire rack or shelf supports the tray so that the peripheral edges thereof are spaced from the oven walls. Such walls normally include the oven side walls, the oven back panel and the oven door when closed.

Said tray may be the lower of two vertically spaced trays, either or both of which may support food to be cooked.

The tray (or the lower of the two trays if two are fitted) must be spaced above the launch area by a dimension which is such that the tray presents to the magnetron a load which is a poor match for the magnetron in terms of effectiveness of power transfer from the magnetron to the oven cavity. In a particular example it has been found that the tray (or the lower tray) should be spaced between ninety and ninety-five millimeters above the base of the oven cavity from which the microwave power is launched.

The oven preferably has thermal heating means in addition to the magnetron, the thermal heating means providing a forced flow of hot air through the cavity, as a result of air being blown over an electrical resistance heating element by means of a fan. The airflow pattern is preferably such that the hot air enters the oven cavity from one side thereof through a vertically elongated inlet, passes across the oven cavity to the other side thereof where the air is drawn out of the cavity by a fan, this airflow pattern being disclosed in our U.K. patent specification No. 2127658.

In another embodiment, the tray is circular and forms part of a rotatable turntable. The tray may be the lower of two such vertically spaced and interconnected trays which effectively form a two-tier turntable. Food may be placed on the lower tray, leaving the upper tray vacant, or vice versa, or food may be placed on both trays, but in any event the loading provided by the food in the cavity determines the amount of energy coupled to the cavity by the magnetron.

The turntable is preferably driven by a rotatable drive member extending upwardly through the base of the cavity, and this drive member may be arranged concentrically with a further drive member which rotates a mode stirrer in the base.

The positioning and size of the two trays in the cavity are important factors in ensuring that the trays present a load which is a poor match for the magnetron in terms of effectiveness of power transfer from the magnetron to the oven cavity. In a particular example it has been found that good results are obtained if the lower tray is between twenty and twenty-five millimeters (preferably about twenty-two millimeters) above the base, the upper tray is between one hundred and seventy and one hundred and ninety millimeters (preferably one hundred and eighty millimeters above the lower tray, and both trays are between three hundred and eighty and four hundred millimeters in diameter. Each tray will normally be made of sheet metal, which may be stove enamelled, and the two trays may be detachably connected together by legs or columns which support the upper tray at the desired spacing above the lower tray.

The air flow pattern is preferably such that hot air is forced into the cavity through two inlets in a rear wall of the cavity, and leaves the cavity through two outlets in the rear wall.

The oven may have a first inlet for the admission of hot air into the cavity above the upper tray and a first outlet for the exit of hot air from the cavity above the upper tray, a second inlet for the admission of hot air into the cavity between the upper and lower trays and a second outlet for the exit of hot air between the upper and lowet trays. There is thus a first hot air circulation system for the space above the upper tray, and a second hot air circulation system for the space between the upper and lower trays.

The trays may be shelves slidably supported in the cavity, but are preferably constituted by the tiers of a two-tier turntable which is rotatably driven about a vertical axis within the cavity.

The first and second inlets and the first and second outlets may be in a rear wall of the cavity with the first inlet disposed above the second outlet and the second inlet disposed above the first outlet so that the directions of forced air flow above and below the upper tray are mutually opposite. The rear wall immediately behind the upper tray and the lower tray is preferably devoid of any hot air inlet or outlet.

Each outlet preferably has a corresponding fan which draws air out of the cavity and through the outlet, before being forced over an electrical resistance heating element which heats the air prior to its re-entry into the cavity through the corresponding inlet. There are preferably two electrical resistance heating elements, one for each hot air circulation system, enabling independent control to be exercised over the forced hot air regime in the two spaces on respective sides of the upper tray.

In a further embodiment, the tray constitutes the sole food-supporting member and is rotatably mounted in the base of the cavity. The turntable is preferably driven by a rotatable drive member extending upwardly through the base of the cavity, and this drive member may be arranged concentrically with a further drive member which rotates a mode stirrer in the base.

The positioning and size of the tray in the cavity are important factors in ensuring that the tray presents a load which is a poor match for the magnetron in terms of effectiveness of power transfer from the magnetron to the oven cavity. In a particular example it has been found that good results are obtained if the tray is between twenty and twenty-five millimeters (preferably about twenty-two millimeters) above the base, and is between three hundred and four hundred millimeters in diameter. The tray will normally be made of sheet metal, which may be stove enamelled.

The oven preferably has thermal heating means in addition to the magnetron, the thermal heating means providing a forced flow of hot air through the cavity, as a result of air being blown over an electrical resistance heating element by means of a fan. The air flow pattern is preferably such that hot air is forced into the cavity through two inlets in a rear wall of the cavity, and leaves the cavity through two outlets in the rear wall.

Three embodiments of microwave oven according to the invention will now be described by way of example with reference to the accompanying drawings in which:

DESCRIPTION OF THE PREFERRED EMBODIMENTS

Figure 1:
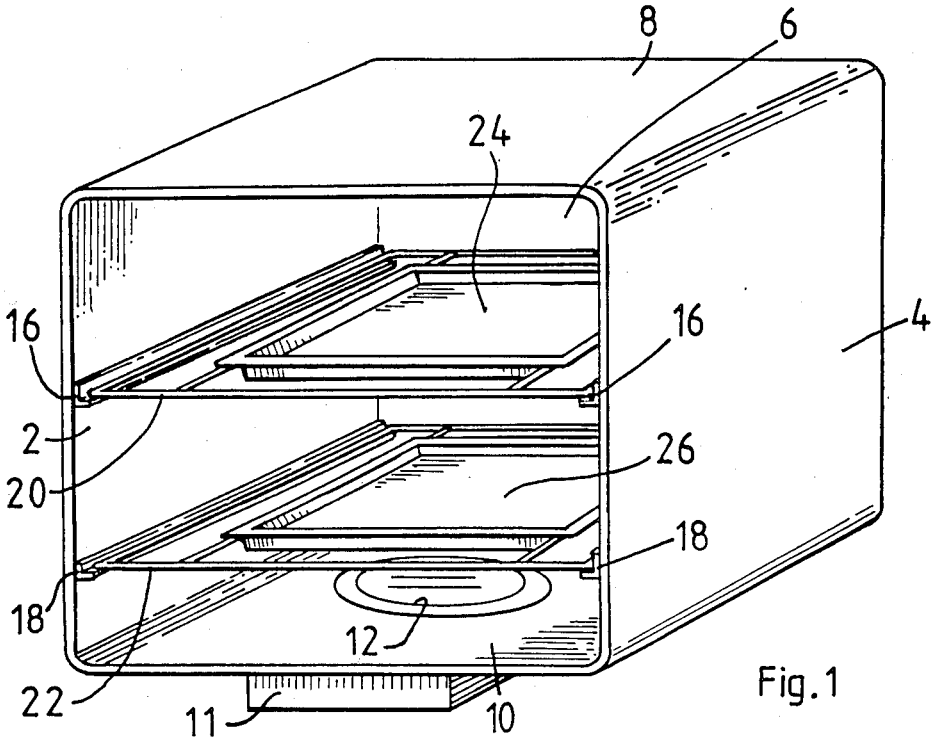
FIG. 1 is a perspective view of the first embodiment of oven with a door of the oven omitted for clarity.

Referring to FIG. 1, the oven is generally rectangular in shape, having two side walls 2, 4, a back panel 6 a top panel 8 and a base panel 10. Within the base panel 10 is a circular aperture 12 forming a launch area through which microwave power is launched into the oven cavity from a magnetron indicated diagrammatically at 11. A rotationally driven member 14 (FIG. 2) located in the aperture 12 acts to distribute the microwave energy throughout the cavity.

Figure 3:
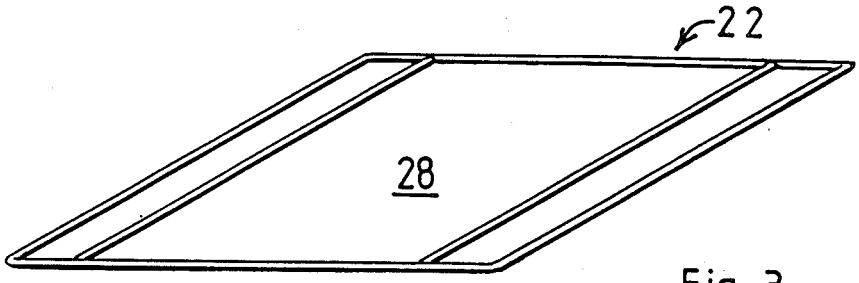
FIG. 3 is a perspective view of an oven shelf of the oven of FIG. 1.
Figure 4:
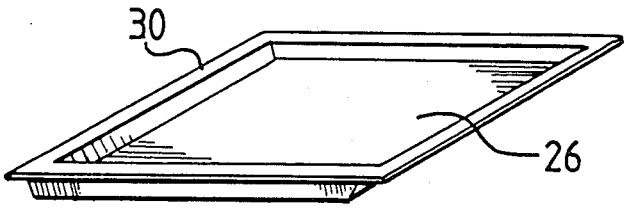
FIG. 4 is a perspective view of an oven tray of the oven of FIG. 1.
Figure 5:
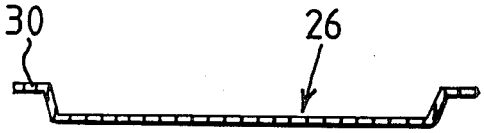
FIG. 5 is a sectional view showing the shape of the tray of FIG. 4, FIGS. 6 and 7 are views similar to FIG. 2 and show two modified constructions.

A pair of upper shelf supports 16 and a pair of lower shelf supports 18 are attached to the side walls 2 and 4. The upper supports 16 support an upper shelf 20, and the lower supports 18 support a lower shelf 22. The upper shelf 20 carries an upper metal tray 24 and the lower shelf 22 carries a lower metal tray 26. FIG. 3 shows the shelf 22, it being understood that the shelf 20 is identical, and FIG. 4 shows the tray 26, it being understood that the tray 24 is identical.

The shelf 22 is made of metal rod and is like a conventional oven shelf except that the central portion is an enlarged aperture 28 to receive the tray 26. The tray 26 is of metal and its entire surface is stove enamelled to prevent metal to metal contact between the tray and the shelf. The tray 26 is rectangular in shape and has around all four edges an out-turned flange or lip 30 which rests on the metal shelf 22 to support the tray in the position shown in FIG. 1.

Figure 2:
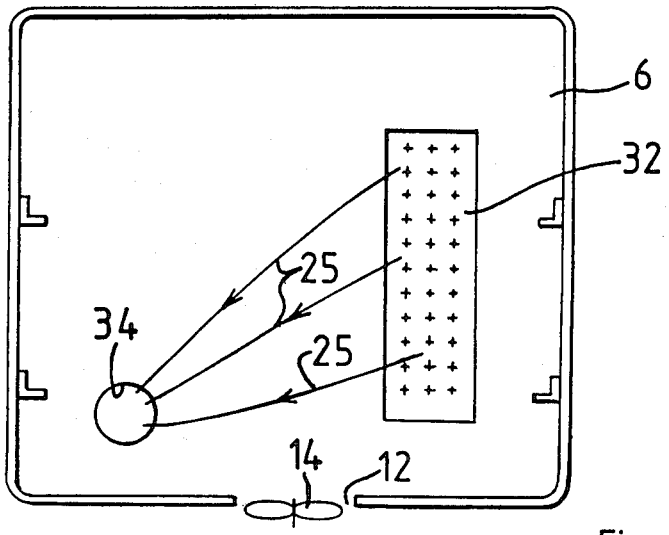
FIG. 2 is a front elevation of the oven of FIG. 1, showing shelves and trays of the oven removed.

Referring to FIG. 2, the back panel 6 mounts a panel 32 formed with plurality of perforations comprising smaller inlet holes for a supply of hot air forced into the oven cavity by means of a fan located in a compartment behind the back panel 6. After passing through the cavity, the hot air is drawn out of the cavity through a circular outlet aperture 34. The fan then causes the air to pass over an electrical resistance heating element whence it is recirculated through the oven cavity. Air flow through the cavity is indicated by lines 25 in FIG. 2.

Both trays 24 and 26 are supported in the oven cavity so that their out-turned lips 30 are spaced from the side walls 2 and 4, the back panel 6 and the oven door when closed. This ensures that there is space around all four sides of each tray 24 or 26 to enable microwave energy to reach the regions above the trays. The positioning of the lower tray 26 is important as it must be spaced from the launch area by a distance so that the tray 26 presents to the magnetron a load which is a poor match with respect to the magnetron. As a result, the amount of power delivered by the magnetron to the empty oven is small, and this low degree of power coupling can be seen on a Rieke diagram.

If a food item is now placed on the lower tray 26 the effectiveness of coupling is slightly increased and the load (ie the food item) absorbs microwave power in accordance with its dielectric properties. If the same food item is placed on the upper tray 24 instead of the lower tray 26 the same result is achieved. If two food items are placed respectively on the two trays 24 and 26 the degree of power coupling between the loads and the magnetron is increased, and the power input to the cavity is increased but the power absorbed by each load remains the same, or substantially the same. This important result means that a food item will take the same time to be cooked regardless of which tray 24 or 26 the load is placed upon and regardless of whether the other tray is loaded or not. The same result is achieved if food is supported on the shelf or shelves 20, 22, the trays 24, 26 having previously been removed.

A particular oven used for tests has a cavity height of three hundred and ninety-six millimeters, a cavity depth of four hundred and twenty millimeters, a cavity width of four hundred and fifty millimeters, a lower shelf 22 spaced ninety millimeters above the base panel 10 and an upper shelf 24 two hundred and thirty millimeters above the base panel 10. Each tray 24 or 26 is three hundred and ten millimeters square and is twenty millimeters deep. With such a configuration it has been found that the dielectric load of food items placed in the cavity determines the extent of power coupling from the magnetron into the cavity and in consequence the amount of power absorbed by any food item (and therefore the time taken to cook) is dependent almost entirely on the dielectric properties of the food item. This means that the food item determines the amount of power which it absorbs so that it is not necessary for the operator to preselect any particular microwave power setting.

Figure 6:
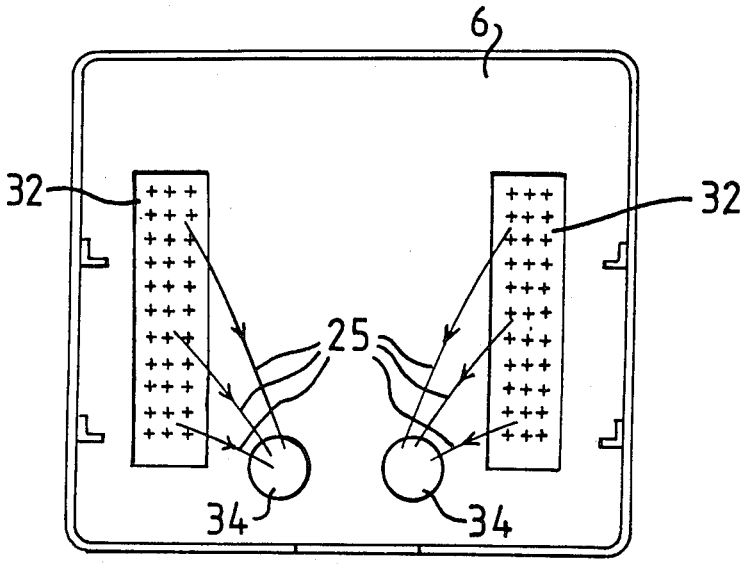

FIG. 6 shows the back panel 6 of the cavity of an oven having a modified air flow pattern. The panel 6 has two perforated pnels 32 mounted thereon, forming hot air inlets, and two circular apertures 34 which are hot air outlets. The flow of hot air through the cavity is generally symmetrical with respect to the central vertical plane of the oven, the air flow pattern being indicated by lines 25 in FIG. 6.

Figure 7:
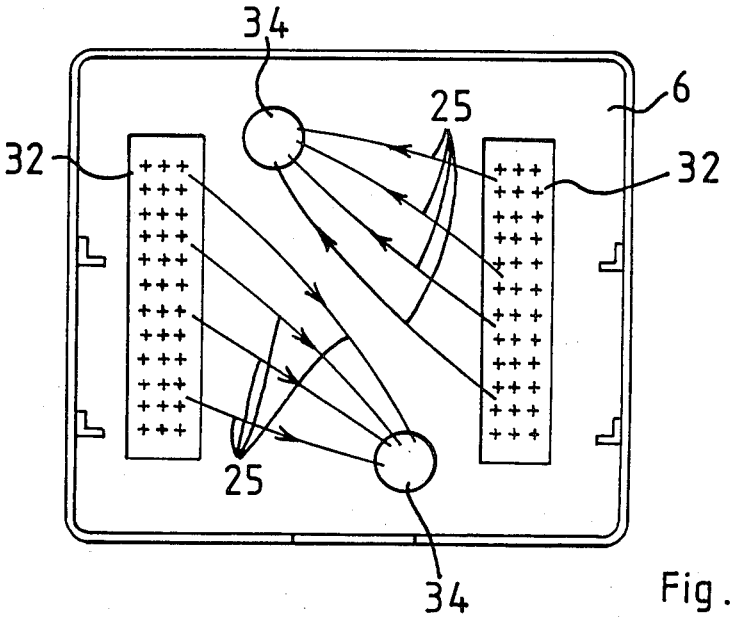

A further modification of the air flow pattern is shown in FIG. 7. Two perforated panels 32 forming hot air inlets are mounted as before on panel 6, but in this case the circular apertures 34 which are the hot air outlets are different locations. One of the outlets is adjacent the top of the back panel 6, and the other adjacent the bottom of the back panel 6, the resulting air flow pattern being shown by lines 25. It will be noted that in FIG. 7 the air flow passes across the central vertical plane of the oven.

Figure 8:
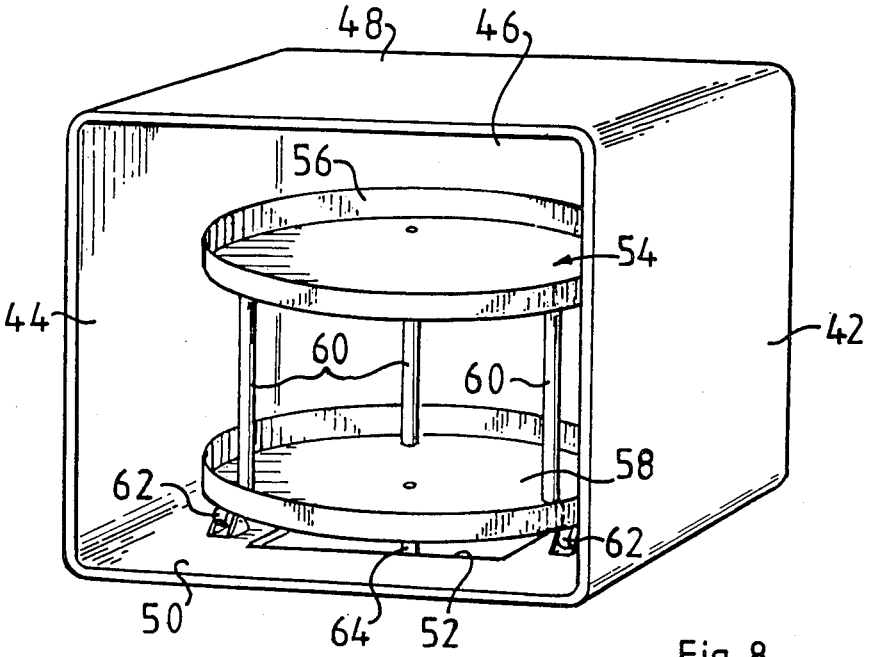
FIG. 8 is a perspective view of the oven cavity of the second embodiment of oven, with a door and surrounding structure removed.

Instead of having slidable shelves supporting trays which are stationary during cooking, the oven may have one or more food-supporting shelves rotatable about a central vertical axis in the cavity. In this case, the rotatable tray, and the lower rotatable tray if there are a plurality of trays, performs the same function as tray 26 in presenting to the magnetron a poor load match. Referring to FIG. 8, the second embodiment of oven is generally rectangular in shape and the cavity is defined by two side walls 42, 44 and a back wall 46, a top panel 48 and a base panel 50. Microwave power is launched into the cavity through a rectangular aperture 52 in the base panel 50. A mode stirrer (not shown) is mounted in the aperture 52 and is rotabably driven about a vertical axis.

The cavity accommodates a removable two-tier turntable 54 having an upper tray 56 and a lower tray 58. Each tray 56 or 58 has a circular base three hundred and ninety millimeters in diameter, surrounded by an upstanding wall or rim twenty-five millimeters high. Each tray is formed of sheet metal which may be stove enamelled. The cavity may have a height of four hundred millimeters, a width of four hundred and fifty millimeters and a depth of four hundred and eighteen millimeters. The two trays 56, 58 are detachably interconnected by three columns 60, which are made of a synthetic plastics material such as PTFE and which provide a spacing of one hundred and eighty millimeters between the trays 56, 58. The lower tray is spaced twenty-two millimeters above the base panel 50, and the underside of the lower tray is engaged by rollers 62 which are mounted on the base panel 50.

Drive means for rotating the turntable extend upwardly through the aperture 52 and is shown diagrammatically at 64. Such drive means is coaxially arranged with the drive to the mode stirrer, for example by the turntable being rotatably driven by a central vertical shaft surrounded by a drive sleeve driving the mode stirrer. The drive shaft and drive sleeve are driven at their appropriate speeds, e.g. by belt drives from a motor. It will be appreciated that all this structure will be positioned below the cavity but within the oven outer casing which is not shown in the drawings.

Figure 9:
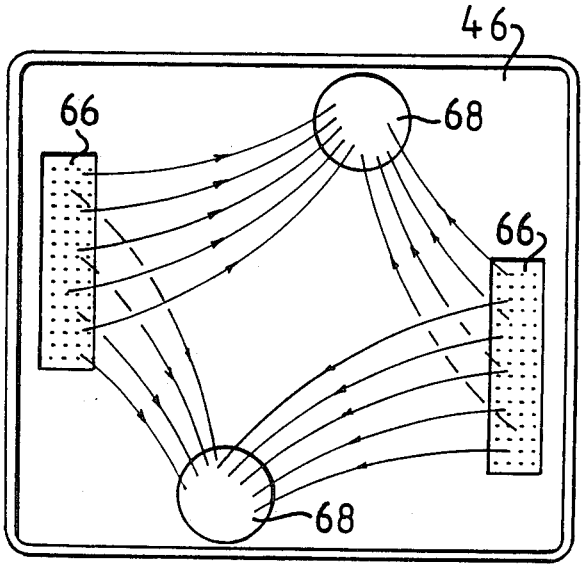
FIG. 9 is an elevation of a rear wall of the oven cavity of FIG. 8 showing inlet and outlet apertures for a forced flow of hot air.

A forced air flow of hot air is passed through the cavity simultaneously with the application of microwave power, so that food items placed on the upper tray 56, the lower tray 58 (or both trays) are subjected both to hot air and microwave power. FIG. 9 shows the hot air inlets and outlets in the back wall 46, as the latter is viewed from the front of the oven. The back wall 46 has two vertically elongated panels, each having a plurality of inlets 66 through which hot air is forced by a fan to enter the cavity. Having passed over the food items, the air leaves the cavity through the circular air outlets 68. The air is then forced over an electric resistance heating element (disposed in a compartment behind the rear wall 46) before being recirculated through the inlets 66 and the cavity. The lines with arrows in FIG. 9 depict the air flow diagrammatically: it will be appreciated that the hot air is forced forwardly into the cavity from the inlets 66 before being drawn back to the outlets 68. It will also be appreciated that the cavity has a moisture vent, for example in the back wall 46.

The trays 56 and 58 and the columns 60 are detachable from one another but are capable of being interengaged so as to form a unit which rotates as a whole in the cavity during use. The turntable therefore rotates about a central vertical axis, the underside of the lower tray 58 engaging the rollers 62.

Figure 10:
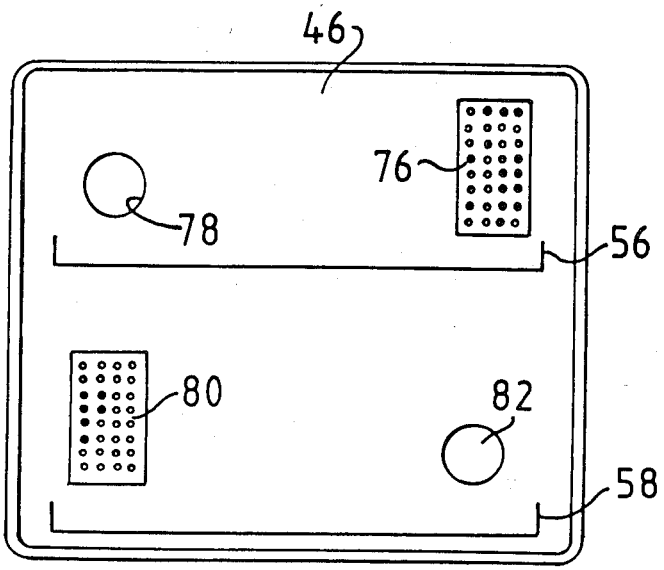
FIG. 10 is a diagrammatic elevation of a rear wall of the oven cavity, showing inlets and outlets for forced flow of hot air in a hot air system alternative to that of FIG. 9.

FIG. 10 shows an alternative hot air system to that of FIG. 9. The back wall 46 has a first panel having a plurality of hot air inlets 76 and a first hot air outlet 78, both disposed above the upper tray 56. Also, the back wall has a second panel having a plurality of hot air inlets 80 and a second hot air outlet 82, both disposed below the upper tray 56 but above the lower tray 58. Each plurality of hot air outlets 78 and 82 has its own fan which draws hot air from the cavity, passes the air over a corresponding one of two electrical resistance heating elements behind the wall 46 and then back into the cavity by the corresponding inlet. In consequence, there is a first hot air system serving the cavity above the upper tray 56, and a second hot air system serving the cavity between the trays 56 and 58. Each hot air system may be controlled independently of the other. The hot air inlets 76 are disposed above the outlet 82, and the hot air inlets 80 are disposed below the outlet 78, so that the hot air flow is generally from right to left above the tray 56, and from left to right in the space between the trays 56 and 58.

Figure 11:
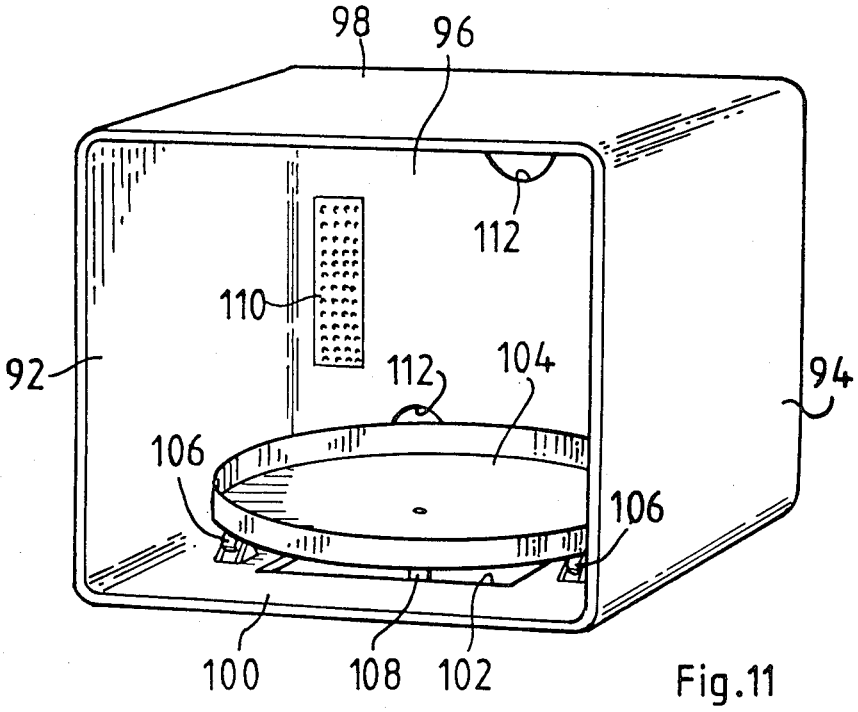
FIG. 11 is a perspective view of the oven cavity of the third embodiment of oven with a door and surrounding structure removed.

Referring to FIG. 11, the third embodiment of oven is again generally rectangular in shape and the cavity is defined by two side walls 92, 94, a back wall 96, a top panel 98 and a base panel 100. Microwave power is launched into the cavity through a rectangular aperture 102 in the base panel 100. A mode stirrer (not shown) is mounted in the aperture 102 and is rotatably driven about a vertical axis.

The cavity accommodates a removable turntable in the form of a metal tray 104. The tray 104 has a circular base three hundred and ninety millimeters in diameter, surrounded by an upstanding wall or rim twenty-five millimeters high. The tray is formed of sheet metal which may be stove enamelled. The cavity may have a height of four hundred millimeters, a width of four hundred and fifty millimeters and a depth of four hundred and eighteen millimeters. The tray 104 is spaced twenty-two millimeters above the base panel 100, and the underside of the tray 104 is engaged by rollers 106 which are mounted on the base panel 100.

Drive means for rotating the turntable extend upwardly through the aperture 102 and is shown diagrammatically at 108. Such drive means is coaxially arranged with the drive to the mode stirrer, for example by the turntable being rotatably driven by a central vetical shaft surrounded by a drive sleeve driving the mode stirrer. The drive shaft and drive sleeve are driven at their appropriate speeds, e.g. by belt drives from a motor. It will be appreciated that all this structure, together with a magnetron for delivering the microwave power, will be positioned below the cavity but within the oven outer casing which is not shown in the drawings.

Figure 12:
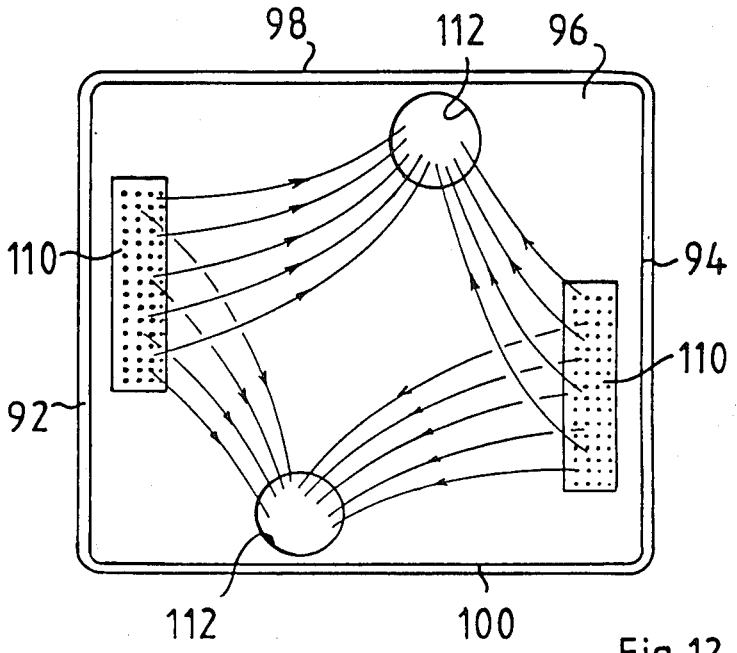
FIG. 12 is an elevation of a rear wall of the oven cavity of FIG. 11, showing inlet and outlet apertures for a forced flow of hot air.

A forced flow of hot air is passed through the cavity simultaneously with the application of microwave power, so that food items placed on the tray 104 are subjected both to hot air and microwave power. FIG. 12, which is similar to FIG. 9, shows the hot air inlets and outlets in the back wall 96, as the latter is viewed from the front of the oven. The back wall 96 has two vertically elongated panels, each having groups of inlets 110 through which hot air is forced by a fan to enter the cavity. Having passed over the food items, the air leaves the cavity through the circular air outlets 112. The air is then forced over an electric resistance heating element (disposed in a compartment behind the rear wall 96) before being re-circulated through the inlets 110 and the cavity. The lines having arrows in FIG. 12 depict the air flow diagrammatically, it will be appreciated that the hot air is forced forwardly into the cavity from the inlets 110 before being drawn back to the outlets 112. It will also be appreciated that the cavity has a moisture vent, for example in the back wall 96.

In use, the turntable rotates about a central vertical axis, the underside of the tray 104 engaging the rollers 106. It will be appreciated from the foregoing description of the various embodiments of an oven in accordance with the invention that the cavity in each embodiment is a multi-mode cavity with a large number of resonances. Thus, the magnetic pattern of each cavity is complex and continuously changing due to driver member 14 (FIG. 2). Driver member 14 is a mode stirrer which couples to different resonant modes in the cavity. This and other adaptabilities and capabilities of the invention will be understood by those skilled in the art from the description herein as well as through experience with the disclosed embodiments and obvious variations thereof.

Having disclosed my invention, what I claim as new and to be secured by Letters Patent of the United States is:

1. A microwave oven comprising: a cavity; a magnetron coupled to said cavity for producing microwave power in said cavity; said cavity being defined by cavity walls, means for launching said microwave power into said cavity, means for distributing said microwave power directly into said cavity; said cavity, said distributing means and said launching means being constructed and arranged so that said cavity is a multimode cavity with a large number of electric field resonances; and a metal tray supported in said cavity a predetermined distance above said launching means with the peripheral edges of said tray spaced further predetermined distances from said cavity walls so that the oven when devoid of food is ineffective in terms of effectiveness of power transfer from said magnetron to said cavity including said tray, and the effectiveness of power coupled and transferred to the loaded oven from said magnetron increases as a function of the dielectric load of food items placed on said tray in said cavity whereby the effectiveness of said power transfer is automatically accommodated to said food load in response thereto.

2. A microwave oven according to claim 1, wherein said tray is stove enamelled and of rectangular or square shape, said tray being supported in the oven by a wire rack or shelf which rests on shelf supports on said cavity walls and which supports said tray so that said peripheral edges thereof are spaced the aforesaid further predetermined distances from said cavity walls and said tray is said first-mentioned predetermined distance above said launch area.

3. A microwave oven according to claim 2, wherein said tray is the lower of two vertically spaced trays, either or both of which are adapted to support food to be cooked.

4. A microwave oven according to claim 1, wherein the oven has thermal heating means in addition to said magnetron, said thermal heating means providing a forced flow of hot air through said cavity as a result of air being blown over an electrical resistance heating element by means of a fan, the air flow pattern being such that the hot air enters said cavity from one side thereof through vertically elongated inlet means, and passes across said cavity to the other side thereof where the air is drawn out of said cavity by a fan.

5. A microwave oven according to claim 1, wherein said tray is circular and forms part of a rotatable turntable.

6. A microwave oven according to claim 5, wherein said tray is the lower of two such vertically spaced and interconnected trays which form a two-tier turntable.

7. A microwave oven according to claim 6, wherein the oven has first inlet means for the admission of hot air into said cavity above the upper of said trays and first outlet means for the exit of hot air from said cavity above said upper tray, second inlet means for the admission of hot air into said cavity between the upper and lower of said trays and second outlet means for the exit of hot air between the upper and lower of said trays.

8. A microwave oven according to claim 7, wherein said first and second inlet means and said first and second outlet means are in a rear wall of said cavity, with said first inlet means disposed above said second outlet means and said second inlet means disposed above said first outlet means so that the directions of forced air flow above and below said upper tray are mutually opposite.

9. A microwave oven according to claim 8, wherein each such outlet means has a corresponding fan which draws air out of said cavity and through said outlet means before being forced over an electrical resistance heating element which heats the air prior to its re-entry into said cavity through the corresponding said inlet means.

10. A microwave oven according to claim 1, wherein said tray constitutes the sole food-supporting member and is rotatably mounted in said base of the cavity.

11. A microwave oven according to claim 1 wherein said microwave power coupled to said oven increases substantially in proportion to increases in said load placed in the oven.

12. A microwave oven as claimed in claim 1, wherein said means for distributing the microwave power in said cavity is a rotationally driven member which rotates between said magnetron and said cavity.

* * * * *